United States Patent [19]

Juers

[11] Patent Number: 4,995,913

[45] Date of Patent: Feb. 26, 1991

[54] LOW WASH WATER SILVER HALIDE FILM PROCESSOR

[75] Inventor: Daniel F. Juers, Fairport, N.Y.

[73] Assignee: E. I. du Pont de Nemours and Company, Wilmington, Del.

[21] Appl. No.: 316,656

[22] Filed: Feb. 28, 1989

[51] Int. Cl.[5] ..... B08B 7/04

[52] U.S. Cl. ..... 134/13; 134/18; 134/26; 354/324; 354/331; 430/398

[58] Field of Search ..... 134/18, 16, 15, 122 R, 134/26; 430/398; 354/324, 331

[56] References Cited

U.S. PATENT DOCUMENTS

| | | | |
|---|---|---|---|
| 2,650,888 | 9/1953 | Pottberg | 134/16 |
| 3,432,271 | 3/1969 | Wasilewski | 134/15 |
| 4,641,941 | 2/1987 | Yoshimi | 354/331 |
| 4,719,173 | 1/1988 | Hahn | 134/122 R |
| 4,810,306 | 7/1989 | Noren | 134/26 |

*Primary Examiner*—Anthony McFarlane

[57] ABSTRACT

A method is disclosed for controlling the flow rate of wash water in a silver halide film processor.

7 Claims, 2 Drawing Sheets

LOW WASH WATER SILVER HALIDE FILM PROCESSOR

BACKGROUND OF THE INVENTION

Field of the invention: This invention relates to silver halide film processors and more particularly to a method for minimizing the amount of wash water used in the fix and wash stage of silver halide film processing equipment.

DESCRIPTION OF THE PRIOR ART

Processing of silver halide films as used in this application comprises the development of silver halide film sheets or web by subjecting the film to development, fix and wash stages. The film typically, but not necessarily, carries a latent image thereon which is rendered visible and permanent as a result thereof.

Equipment to facilitate and speed the processing is widely available in the art. Such equipment typically comprises a series of tanks or similar stations through which a film is passed sequentially. Each station contains either a developer chemical or a fixer chemical or water for washing the chemicals off the film surface once the desired chemical's effect on the film has been obtained.

The chemicals may be used in small quantities, in concentrated form and appropriately replenished, thus permitting their handling without the need for substantial, if any, external to the apparatus plumbing. The wash stages on the other hand, heretofore have required a substantial amount of water flow and associated plumbing to supply fresh water as well as to provide an outlet for the wash water after it has contacted the film.

In order to minimize the amount of water used, in the wash stages of a processor, it is known to use multiple wash stages employing either a counter current fluid flow, or a con-current fluid flow, as described in detail in U.S. Pat. No. 4,719,173.

A simple way to obtain this counter- or con-concurrent fluid flow is through the use of overflow tanks of the type disclosed in U.S. Pat. No. 4,641,941.

Yet, when all the teachings of U.S. Pat. No. 4,719,173 are implemented, whether counter- or concurrent flow is employed, a substantial amount of wash water is still used because in an effort to obtain complete washing of the film an excess of water flow is provided. It is of course well known in the film developing art that the existence of residual chemicals on processed film particularly thiosulfate, eventually results in undesirable film staining or image degradation. Yet, the obvious solution of using ample water to wash the film is becoming impractical because of the need to properly dispose of the contaminated water, especially when the equipment is used in an office environment.

There is thus a strong need to minimize the amount of wash water used in silver halide film processors, and for a method to avoid using any excess water over what is necessary to produce complete washing of the film and at the same time comply with water discharge regulations of any given municipality.

It is thus an object of this invention to provide such a method for determining and adjusting the flow rate of replenishment water in a silver halide processor in such manner as to comply with pertinent effluent regulations while using only as much water as is needed for a complete wash of the film.

SUMMARY OF THE INVENTION

The above object is obtained by adjusting the flow rate to minimize the use of wash water in a photographic film processor of the type using multiple wash stages including a first and a last stage in a countercurrent wash arrangement to wash a film after it has been developed and fixed in a fixing solution containing thiosulfate, the method comprising:

1. Determining the number of wash stages (n);
2. Selecting the desired level of residual thiosulfate (R) left on the processed film;
3. Determining the concentration of thiosulfate (Cf) in the fixing solution;
4. Determining the amount of wash water ($V_c$) carried over between wash stages;
5. Selecting the film processing rate (Ar); and
6. Adjusting the flow rate $V_r$ of the wash water to a rate such that $$\frac{C_f V_c}{R} = \sum_{k=o}^{n} \left( \frac{V_r}{V_c A_r} \right)^k$$

Preferably, the residual thiosulfate level R selected in step (2) above is selected equal to or less than 0.014 gms of thiosulfate per square meter of film.

The adjustment of the flow-rate in accordance with the relationship given in step (6) above may also be done using a look up table comprising a set of precalculated values for different numbers of wash stages, thiosulfate residual levels, thiosulfate concentrations in the fixing solution, wash water carry over and film processing rates.

In the alternative, step (6) above may be implemented by adjusting the wash water flow rate through reference to a family of curves satisfying the relationship give in step (6), wherein the ordinate axis represents the value $C_f V_c/R$, the abscissa equals $V_r/(V_c{*}A_r)$ and the family of curves is calculated for different values of (n).

In the practice of this invention, both the table of values or the family of curves may have been precalculated on the basis of results of measurements done at any time prior to the adjusting step.

BRIEF DESCRIPTION OF THE DRAWINGS

The invention will best be understood with reference to the drawings, in which.

DETAILED DESCRIPTION OF THE INVENTION

Figure 1:
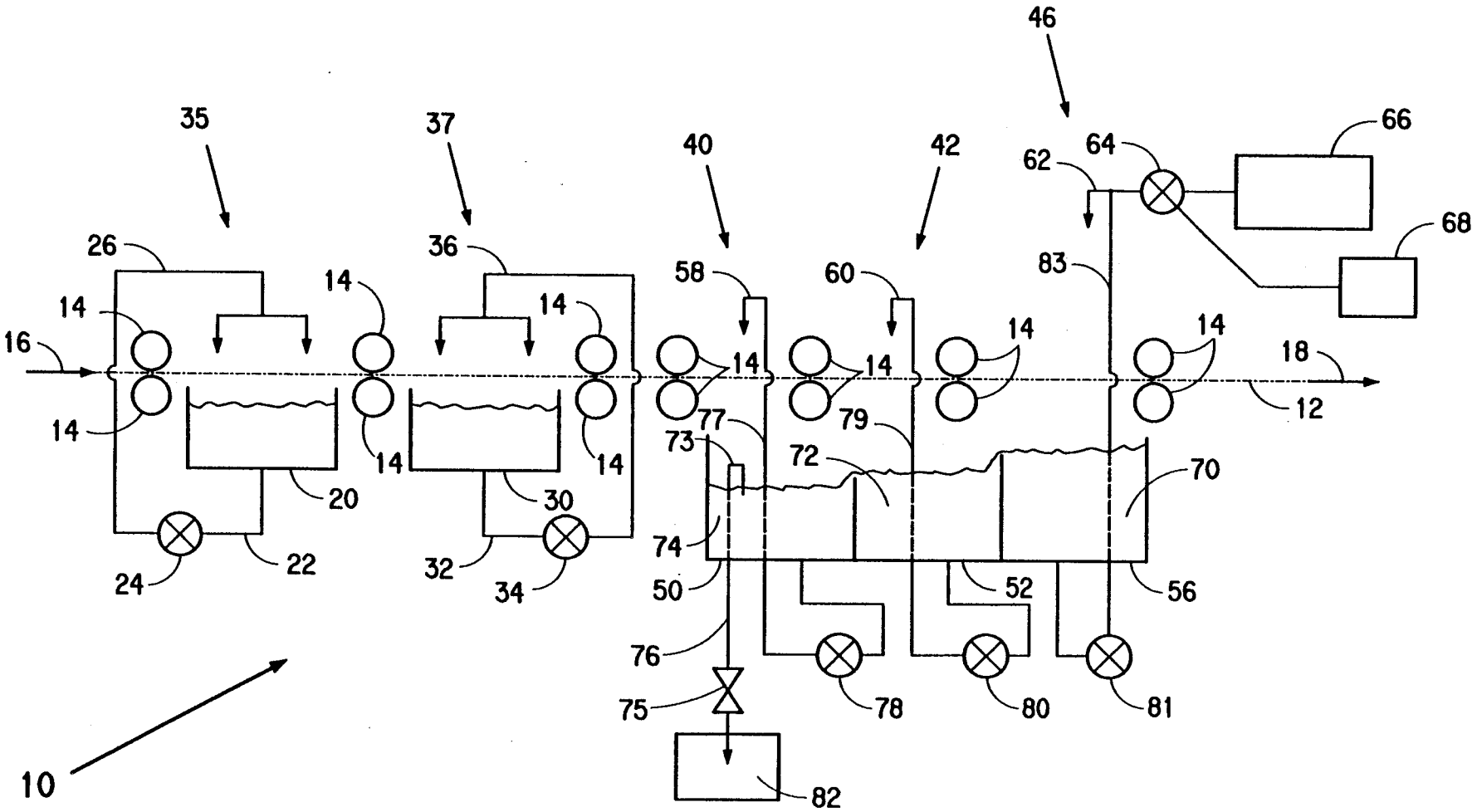
FIG. 1 Shows a schematic representation of a counter flow film processor

FIG. 1 shows in schematic representation of a film processor of the type useful in practicing the method of the present invention. The processor comprises a multitude of film transport rollers 14 arranged to grip a film sheet or film web as it enters the processor along arrow 16 and drive it through a number of film processing stations 35, 37, 40, 42 and 46 in the direction of arrow 18. Station 35 is typically a film development station. It comprises a developer containing tank 20 which is connected through a piping system 22 to a pump 24 and a developer applicator means 26 for contacting developer with the film. Excess developer is returned back to the developer tank 20.

Fixing station 37 also comprises a fixer containing tank 30 which through a piping system 32 and a pump 34 supplies fixer to a fixer applicator 36 for contacting fixer with the film. Excess fixer is returned to the fixer tank 30.

While the details of contacting the developer and fixer with the film are not shown or important to this invention, since such means are well known in the art, such contact may take the form of sprays, liquid pools, liquid immersion tanks and the like.

The specific embodiment depicted in FIG. 1 shows a processor having a 3 stage wash station, comprising stages 40, 42 and 46. In the third and last stage 46, clean water from water source 66 is supplied through flow rate regulator 64 to a water applying means such as spray 62 to contact a processed film. A controller 68 which may be as sophisticated as a computer or as simple as a manual valve control is used to regulate the flow of fresh water into the system. A recirculating pump 81 and piping system 83 is used to mix fresh water and wash water and apply it through applying means 62 to wash the film in wash stage 46. A tank 56 is conveniently placed to collect the water 70 after it has contacted the film surface in the last wash stage 46. At this point the film surface has already been contacted with water twice before in the present arrangement. Thus water 70 is the least contaminated.

Overflow from tank 56 is directed into tank 52. Through recirculating pump 80 and piping system 79, the water 72 from tank 52 is used to wash the film in the second wash stage 42 through water applicator means 60 which may again be a spray. Tank 52 is also placed so as to collect the wash water of this wash stage 42.

Overflow water 72 from tank 52 is directed into tank 50. A recirculating pump 78 and piping system 77 directs water 74 from tank 50 to a water applicator 58 which may again be a spray. This water is used to wash the film in the first wash stage 40. Tank 50 is also positioned so as to capture the water used to wash the film. Water 74 is the most contaminated water, since it contains all the wash by-products from tanks 56 and 52 in addition to being the first wash water to contact the film as it exits the fixer station 37. A drain pipe 76 directs water 74 through a drain flow control valve 75 to a drain or an effluent collector 82. In a preferred embodiment valve 75 may be eliminated in favor of an overflow arrangement 73. The flow out is of course regulated to match the flow in of fresh water to prevent any net accumulation of water.

The processing of silver halide films comprises first contacting the film with a chemical developer solution. The chemical developer solution converts exposed silver halide crystals into metallic silver.

Following development, the film is subjected to a fixing process. During fixing, any remaining undeveloped silver halide crystals are dissolved by a chemical fixer comprising among other chemicals, thiosulfate, and removed from the film, while the metallic silver constituting the image, remains on the film.

The fixed film is washed, typically with water, to remove all traces of silver salts and fixer solution from it. It is towards the conservation of wash water used in this stage that the present invention method is directed. The present method describes a process by which the amount of wash water used in processing film is minimized, by using a counterflow wash system and by replenishing the wash water at a controlled rate calculated to satisfy the following relationship:

$$\frac{C_f V_c}{R} = \sum_{k=o}^{n} \left( \frac{V_r}{V_c A_r} \right)^k$$

Where:

Cf = Concentration of thiosulfate in the fixing solution in grams per milliliter, both in free form and complexed with silver Vc = Amount of wash water absorbed in the film, in milliliters per square meter of film, transferred from wash station i to wash station i+1, the final wash station being n n = number of wash stations R = Residual thiosulfate concentration on processed film in grams/square meter of film Ar = rate of film processing in square meters per minute Vr = Replenishment, fresh water, rate in milliliters per minute.

In a generalized form the film washing process described in FIG. 1, the rate of film advance through each stage is such that equilibrium conditions are reached in each stage.

Film from the fix bath carries $V_c$ ml of fixer per sq. m. of film from the fix station to the first wash stage. The total concentration of thiosulfate in both the free form and complexed with silver is $C_f$ gm thiosulfate per ml. As the film proceeds from stage to stage at a rate of $A_r$ sq. m. per min, it carries $V_c$ ml of wash water per sq. m. of film from stage i to stage i+1. The thiosulfate concentration in stage i is $C_i$ gm thiosulfate per ml. The final wash is stage n. The film carries $V_c$ ml of wash fluid from stage n per sq. m. of film at a concentration of $C_n$ gm thiosulfate per ml out of the stage. This is dried to give a residual thiosulfate concentration of R gm thiosulfate per sq. m. of film. This leads directly to equation 1 below.

$$R = V_c C_n \tag{1}$$

Also, added to the final wash stage n is $V_r$ ml of fresh water per min. As this is added, $V_r$ ml per min. of wash stage n overflows into wash n−1. This overflowing from wash stage to wash stage continues down the line of wash stages until it reaches wash stage 1. Wash stage 1 overflows to a drain. The differential equations that describe the wash process at each of the stages are set equal to zero for the equilibrium case as shown in equations 2 to 4. The V's are the volumes of the various wash stages. Multiplying each equation by the appropriate V, dividing by $V_r$, $$\frac{dC_1}{dt} = \frac{V_c A_r C_f}{V_1} + \frac{V_r C_2}{V_1} - \frac{(V_r + V_c A_r) C_1}{V_1} = 0 \tag{2}$$

$$\frac{dC_i}{dt} = \frac{V_c A_r C_{i-1}}{V_i} + \frac{V_r C_{i+1}}{V_i} - \frac{(V_r + V_c A_r) C_i}{V_i} = 0 \tag{3}$$

for $1 < i < n$ $$\frac{dC_n}{dt} = \frac{V_c A_r C_{n-1}}{V_n} - \frac{(V_r + V_c A_r) C_n}{V_n} = 0 \tag{4}$$

setting $Q = V_c A_r / V_r$, and rearranging gives the following equations.

$$C_1 = \frac{1}{1+Q} C_2 + \frac{Q}{1+Q} C_f \quad (5)$$

$$C_i = \frac{1}{1+Q} C_{i+1} + \frac{Q}{1+Q} C_{i-1} \quad (6)$$

$$C_n = \frac{Q}{1+Q} C_{n-1} \quad (7)$$

The general formula for $C_i$ is given by:

$$C_i = \frac{\sum_{k=0}^{i-1} Q^k}{\sum_{k=0}^{i} Q^k} C_{i+1} + \frac{Q^i}{\sum_{k=0}^{i} Q^k} C_f \quad (8)$$

for $0 < i < n$

Equation (8) reduces to:

$$C_n = \frac{C_f}{\sum_{k=0}^{n} \left(\frac{1}{Q}\right)^k} \quad (9)$$

Now, from the definition of Q, $1/Q = V_r/(V_cA_r)$. Substituting this into equation 9, and then substituting the resulting expression into equation 1 gives after rearrangement:

$$\frac{C_fV_c}{R} = \sum_{k=0}^{n} \left(\frac{V_r}{V_cA_r}\right)^k \quad (10)$$

In practice, the procedure to select the lowest rate for wash replenishment, $V_r$, is as shown below:

1. Select the desired level of residual thiosulfate, R, to be left in the washed and dried film. The American National Standards Institute standard for satisfactory washing is less than 0.014 gm thiosulfate per sq. m. of film, and may be used as a desirable value. (ANSI Specification PH 1.41 (1984)).
2. From the fixer formulation, determine $C_f$. If the formulation is unknown, $C_f$ may be determined using well known analytical methods such as iodometric titration and the like.
3. Determine n, the number of wash baths in the process.
4. Select the desired processing rate, $A_r$.
5. Determine $V_c$ by cutting out 1 sq. ft. of film to be processed and weighing accurately in grams. Immerse the cut out piece of film in warm water for 1 min. Remove from the water, immediately remove excess water, and reweigh. Multiply the difference between the second and first weights by 10.76 to convert from weight per square foot to weight per square meters. The result is $V_c$.
6. Compute the desired value of $C_fV_c/R$ from the appropriate values from steps 1, 2, and 5.
7. For a series of values of $V_r$ and the appropriate values from steps 3, 4, and 5 above prepare a plot of equation (10).
8. On this graph, draw a line parallel to the abscissa that intersects the ordinate at the value calculated in step 6 above. At the point where this line intersects the plot, draw another line, parallel to the ordinate and read the value where this second line intersects the abscissa. Multiply this value by $V_cA_r$ to get the desired value of $V_r$.

Figure 2:
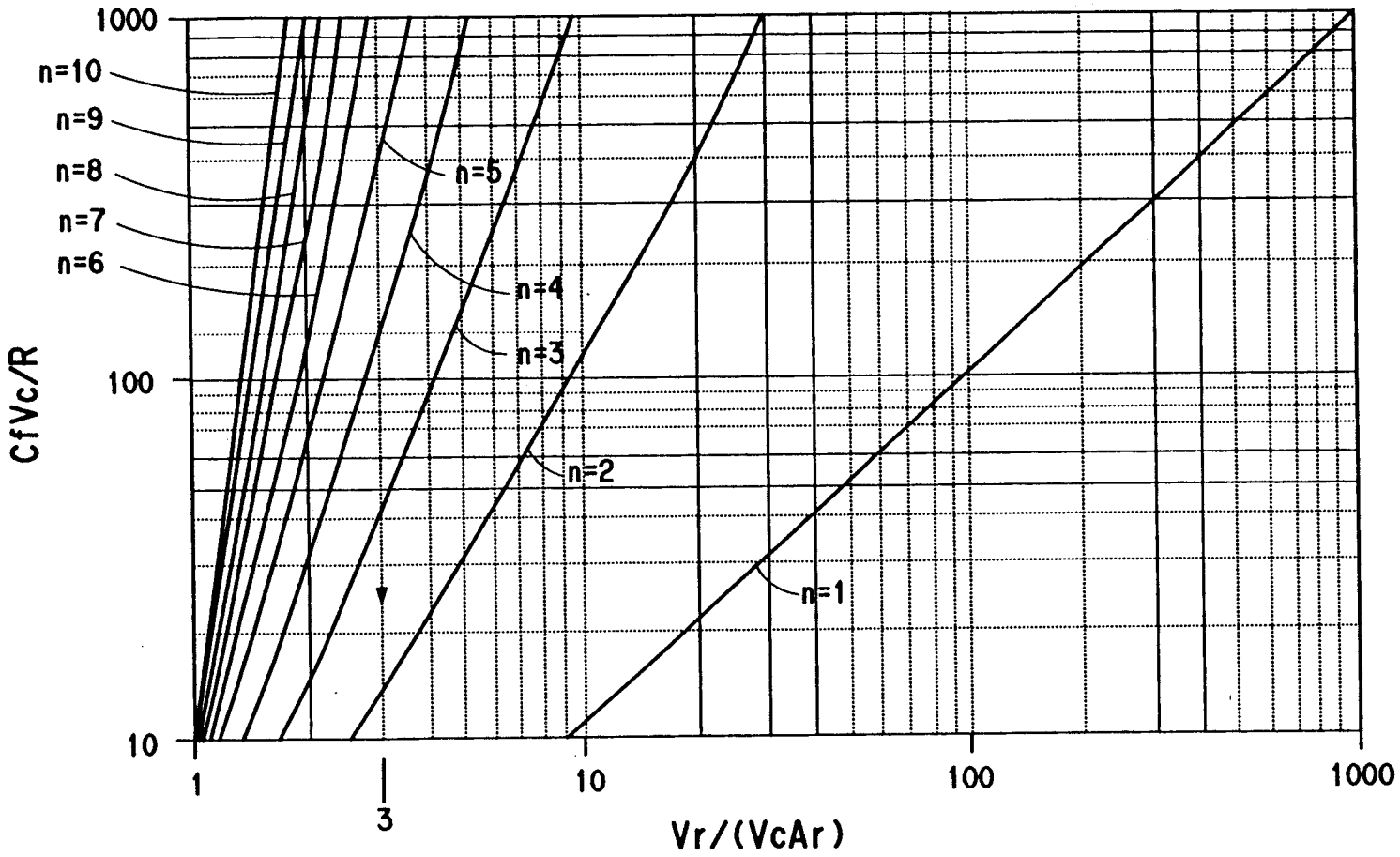
FIG. 2 Shows a set of curves useful in adjusting the wash water flow rate in accordance with this invention.

A series of these plots for values of n from 1 to 10 covering typical values of $C_fV_c/R$ is shown in FIG. 2. Note that equation 10 is plotted as a log-log plot to include a wide range of possibilities.

EXAMPLE

Determination of $V_r$ for a case where n=4.

It is desired to process film at a rate of 0.5 square meters/minute with a residual thiosulfate amount on the dried film not exceeding 0.01 grams/square meter; from the fixer formulation $C_f$ is determined equal to 0.12 grams/milliliter. By performing the procedure of step 5 above we calculate $V_c$=10 milliliters/square meter. Next $C_fV_c/R$=120. Referring to FIG. 2 a line parallel to the X axis drawn from $C_fV_c/R$=120 intersects the curve corresponding to n=4 at a value of $V_r/(V_c{*}A_r)$=3 or $V_r$=3($V_c{*}A_r$)=15 milliliters/minute. The flow rate of fresh water is therefore adjusted to 15 milliliters/minute, either manually or automatically.

In addition to generating a family of curves which facilitates the subsequent solution of equation (10), a set of values may be developed which may be used either as a reference table for manual reference or as a look up table for use in a computer to provide either an indication of the desired flow rate or a completely automatic control of the flow rate as is well known in the art of fluid flow control. In the alternative a computer may be programmed to solve equation (10) every time using the appropriate input values to provide a flow rate indication without need for a look up table.

The invention has heretofore been described with reference to a specific embodiment as shown in FIG. 1. However, in the practice of this invention the apparatus design may vary in known ways such as using liquid transfer pumps to move water from tank to tank rather than an overflow system; similarly, the fresh water addition may be done directly to the tank, i.e. tank 56 rather than to the water applying means 62.

The above and similar variations of the disclosed process are well within the capabilities of the art and contemplated as within the scope of the present invention as claimed in the appended claims.

I claim:

1. A method for processing film in a photographic film processor using a number of wash stages including a first and a last stage in a countercurrent wash arrangement, the method comprising:

a. contacting the film with developer solution;
b. contacting the film with fixing solution containing thiosulfate;
c. determining the number of wash stages (n);
d. selecting a level of residual thiosulfate (R) to be left on processed film;
e. determining concentration of thiosulfate ($C_f$) in the fixing solution;
f. determining an amount of wash water ($V_c$) to be circulated through the wash stages;
g. selecting film processing rate ($A_r$);
h. circulating the wash water through the wash stages and replenishing the wash water with a flow rate ($V_r$) such that $$\frac{C_f V_c}{R} = \sum_{k=o}^{n} \left( \frac{V_r}{V_c A_r} \right)^k \text{; and}$$

i. washing the film with the wash water in the wash stages in a direction generally counter to the circulation of the wash water through the wash stages.

2. The method in accordance with claim 1, wherein the level of residual thiosulfate (R) left on the processed film is less than 0.014 grams of thiosulfate per square meter of film.

3. The method in accordance with claim 2, wherein the number of wash stages (n) equals three (3).

4. The method in accordance with claim 1, further comprising determining the flow rate ($V_r$) using a precalculated family of curves representing multiple solutions of the relationship $$\frac{C_f V_c}{R} = \sum_{k=o}^{n} \left( \frac{V_r}{V_c A_r} \right)^k$$

for preselected values of $C_f$, $V_c$, R, k, n, $V_r$ and $A_r$ to determine the wash water flow rate ($V_r$).

5. The method in accordance with claim 1, further comprising using a computer to calculate the flow rate $V_r$ from the relationship $$\frac{C_f V_c}{R} = \sum_{k=o}^{n} \left( \frac{V_r}{V_c A_r} \right)^k.$$

6. The method in accordance with claim 5, further comprising adjusting the wash water flow rate ($V_r$) automatically in response to the use of said computer to calculate the flow rate ($V_r$).

7. The method in accordance with claim 1, further comprising adjusting the wash water flow rate ($V_r$) to satisfy the equation $$\frac{C_f V_c}{R} = \sum_{k=o}^{n} \left( \frac{V_r}{V_c A_r} \right)^k.$$

* * * * *